United States Patent [19]

Abernethy

[11] Patent Number: 4,969,413

[45] Date of Patent: Nov. 13, 1990

[54] SEA - OR DRAG-ANCHOR

[76] Inventor: William J. Abernethy, Woodville, R.M.B. 128, Delegate, New South Wales, 2633, Australia

[21] Appl. No.: 266,635

[22] PCT Filed: Feb. 25, 1987

[86] PCT No.: PCT/AU87/00054

§ 371 Date: Aug. 23, 1988

§ 102(e) Date: Aug. 23, 1988

[87] PCT Pub. No.: WO87/04988

PCT Pub. Date: Aug. 27, 1987

[30] Foreign Application Priority Data

Feb. 25, 1986 [AU] Australia ..... PH4789
Feb. 17, 1987 [AU] Australia ..... PI0399

[51] Int. Cl.[5] ..... B63B 21/48
[52] U.S. Cl. ..... 114/311; 114/294
[58] Field of Search ..... 114/294, 300, 311, 232, 114/234; 244/1 TD; 441/11, 13; 52/155

[56] References Cited

U.S. PATENT DOCUMENTS

| | | | |
|---|---|---|---|
| 2,491,564 | 12/1949 | Iversen | 114/311 |
| 2,940,411 | 6/1960 | Bartels et al. | 114/294 |
| 3,064,613 | 11/1962 | Hubick | 114/311 |
| 3,310,257 | 3/1967 | Price | 244/1 TD |
| 3,755,836 | 9/1973 | Milazzo | 9/8 |
| 4,096,818 | 6/1978 | Wameling | 114/311 |
| 4,562,788 | 1/1986 | Abernethy | 114/311 |

FOREIGN PATENT DOCUMENTS

| | | | |
|---|---|---|---|
| 1435960 | 12/1966 | France | 244/1 TD |
| 258958 | 10/1926 | United Kingdom | 114/300 |

*Primary Examiner*—Joseph F. Peters, Jr.
*Assistant Examiner*—Edwin L. Swinehart
*Attorney, Agent, or Firm*—Foley & Lardner, Schwartz, Jeffery, Schwaab, Mack, Blumenthal & Evans

[57] ABSTRACT

A sea anchor or drogue having a body comprised of a front section which tapers forwardly to a nose, and a hollow, rearwardly tapering back section. Longitudinal open channels are formed in the front section and lead into the back section, with vanes or tubes defining the sides of the channels. In certain embodiments, baffles are fixed in each channel and oriented so as to direct water into the back section to create the drag effect.

9 Claims, 3 Drawing Sheets

SEA - OR DRAG-ANCHOR

BACKGROUND OF THE INVENTION

1. Field of the Invention

This invention relates to a sea—or drag—anchor.

2. Prior Art

A sea anchor, drag anchor or drogue of the type described and illustrated in Australian Patent Application No. 21643/83 has a hollow body which can be towed behind a vessel by means of a hawser connected to attachment means at the leading end of the body. Ports in the body are normally closed by spring-loaded doors to which the attachment means are operatively connected so that when tension of the hawser reaches a predetermined level the doors are moved inwardly to open the ports and the effective drag of the device is thereupon substantially increased. The controlled restraint afforded by such a device has been found very effective in preventing broaching to and providing reliable emergency steering for a wide variety of vessels. However, the effectiveness of such a device is diminished when towed at the fairly high speed commonly attained by multi-hull vessels. These vessels tend to be unstable in winds at a substantial angle to the direction of movement and have a tendency in such conditions to pitch-pole across the axis of the beam.

SUMMARY OF THE PRESENT INVENTION

The present invention has been devised with the general object of providing a sea anchor or drogue which when towed by a multi-hull vessel in adverse weather conditions will be found to be effective in controlling its speed and contributing substantially to its stability.

With the foregoing and other objects in view, the invention resides broadly in a sea anchor or drogue of the type having a front section forwardly tapering to a nose with means for attachment to a towering hawser and with a hollow rearwardly tapering back section, wherein longitudinal open channels are formed in the front section and lead into the hollow back section, the channels preferably increasing in width from front to their rear entry to the back section and preferably increasing also in depth from front to back. The increase in depth may be brought about by inwardly deflected baffles in the channels. Other features of the invention will become apparent from the following description.

BRIEF DESCRIPTION OF THE DRAWINGS

In order that preferred embodiments of the invention may be readily understood and carried into practical effect, reference is now made to the accompanying drawings, wherein.

DETAILED DESCRIPTION OF THE PREFERRED EMBODIMENTS

Figure 1:
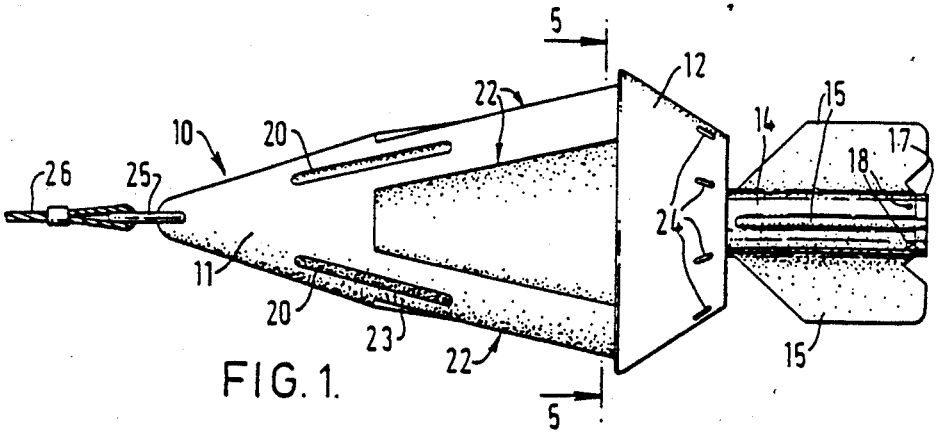
FIG. 1 is a side elevation of a sea anchor or drogue according to the invention.
Figure 2:
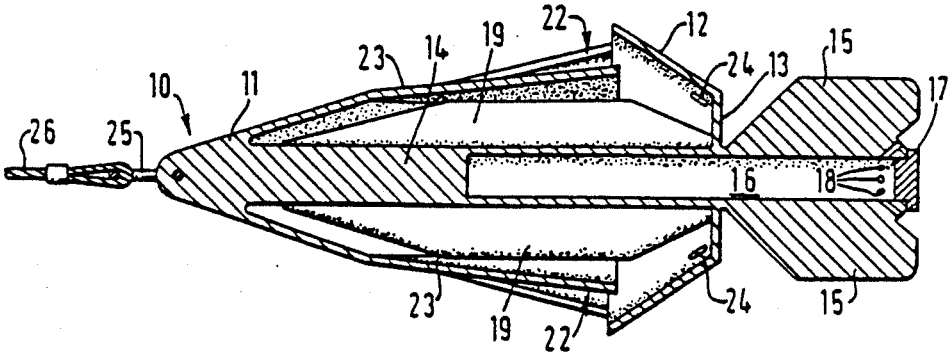
FIG. 2 is a longitudinal sectional view of the device.
Figure 3:
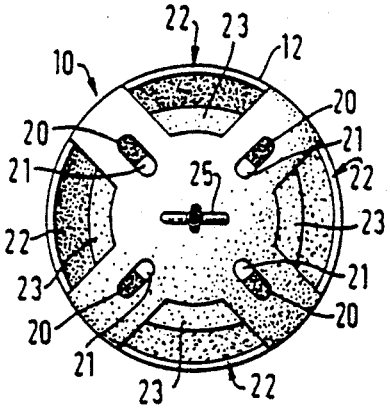
FIG. 3 is a front elevational view of the device.
Figure 4:
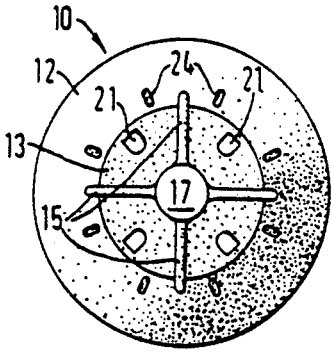
FIG. 4 is a rear view of the device.
Figure 5:
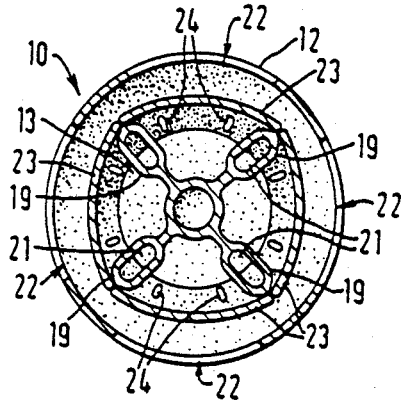
FIG. 5 is a cross-sectional view of the device taken along line 5—5 in FIG. 1.
Figure 6:
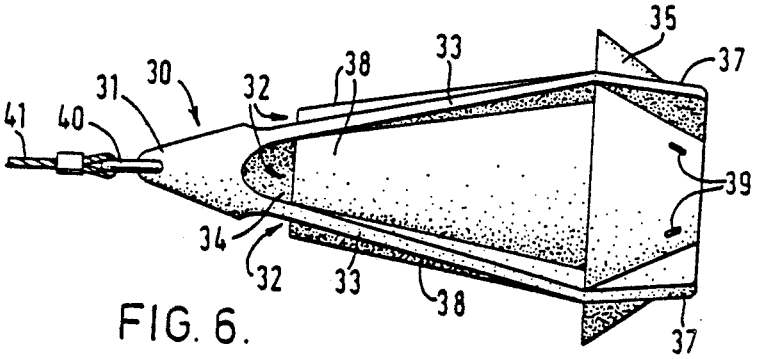
FIG. 6 is a side elevation of a sea anchor or drogue according to an alternative embodiment of the invention.
Figure 7:
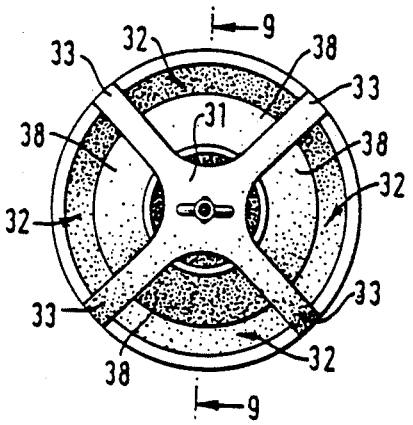
FIG. 7 is a front elevation of the drogue shown in FIG. 6.
Figure 8:
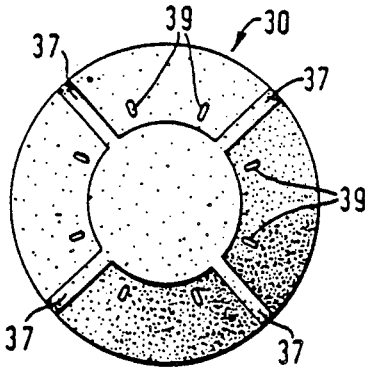
FIG. 8 is a rear elevation of the device of FIG. 6.
Figure 9:
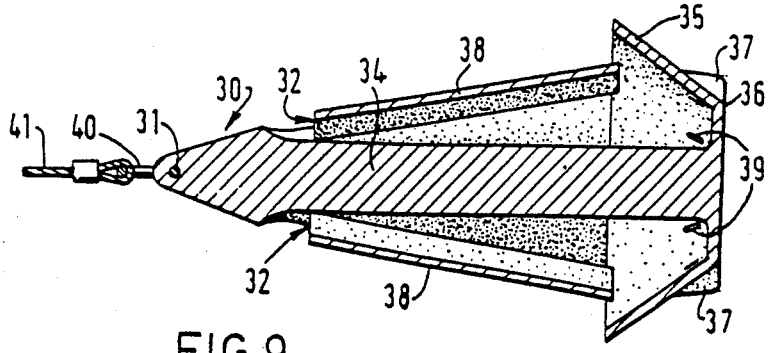
FIG. 9 is a cross-sectional view of the device taken along line 9—9 of FIG. 7.

Referring initially to FIGS. 1 to 5 inclusive, the sea anchor or drogue includes a body 10 moulded of any suitable plastics material and including a generally coned front section 11 increasing in diameter to its rear where it joins a hollow or concave frusto-conical back section 12, tapering to its closed rear end 13.

A cylindrical core 14 disposed coaxially within the body 10 extends rearwards of the back section 12, where it is formed with four radiating stabilizing fins 15 in equally spaced arrangment. An axial chamber 16 is formed in the rear part of the core behind and within the body, and is closed by a removable plug 17. A series of small water passages 18 lead into the rear part of the chamber 16.

Four flow-through tubes 19 are provided within the body 10, radiating in equiangular disposition from the core 14, each having an elongated inlet 20 through the cone front section 11 of the body, and a reduced outlet 21 through the rear end 13 of the back section 12 of the body 10.

Four similar longitudinal channels 22 are formed in equally spaced arrangement in the coned front section 11 of the body 10, each defined by a baffle 23 curved arcuately in cross-section and fixed to the outer parts of two succeeding flow through tubes 19. The baffles 23 are deflected inwardly towards the rear so that the channels 22 progressively increase both in width and in depth from front to rear, where they lead into the concave back section 12 of the body 10.

A series of small relief ports 24 are formed through the frusto-conical wall of the back section 12 of the body 10.

A ring 25 is engaged in a diametral hole through the nose portion of the body so that a towing hawser 26 may be made fast to the device.

In use, in adverse weather conditions, the sea anchor or drogue may be streamed off the windward side of, for example, a multi-hull vessel, and it will be found effective in reducing the speed of the boat while maintaining good stability. Water directed into the concave back section 12 of the body of the device through the longitudinal channels 22 is, for the greater part, expelled forwardly and outwardly from the periphery of the back section 12 with consequent turbulence of the water and the application of drag to the boat through the hawser 26. Water passing through the flow-through tubes 19 and through their restricted rear outlets 21, the stabilizer fins 15, and the configuration of the device, ensure that the drogue tracks truly. The speed of the vessel will be substantially reduced by the drag of the sea anchor, and any tendency of the windward hull to lift will be obviated or very materially reduced.

Normally the chamber 16 is filled with water by way of the passages 18, but in the event of the vessel being in distress, the drogue may be brought inboard, the plug 17 removed and the chamber 19 emptied. A distress signalling device (not shown) of any of a variety of types may be installed in the chamber 16, closing the passages 18, and the device may then be returned to the water, the buoyancy given by the chamber 16 maintaining the device upright in the water.

The modified form of sea anchor or drogue shown in FIGS. 6 to 9 inclusive has a body 30 which, rearwards of its coned nose portion 31, is formed with four equally spaced similar longitudinal channels 32 separated by longitudinal vanes 33 radiating from an axial core 34 within the body. The core, which may be made in two or more parts, extends into the body's back section 35, which is of hollow frusto-conical shape, tapering to its closed rear end 36. The back section 35 is formed integrally with four external stabilizer fins 37 which are aligned with the vanes 33.

A baffle 38, curved arcuately in cross-section, is fixed in each of the channels 32, its rearwardly divergent side edges being fixed to the two vanes 33 defining the sides of the channel. The front end of each of the baffles 38 is spaced behind the front of the channel 32 in which it is fixed, and the rear end of the baffle is disposed concentrically inwards of the periphery of the back section 35 of the body.

The rear section 35 is formed with a series of relief ports 39, as before described in relation to the embodiment of FIGS. 1 to 5. A ring 40 for the attachment of a towing hawser 41 is fixed through the nose section 31 of the device.

This embodiment of the invention is used as before described. Water through which the device is towed enters the longitudinal channels 32 in front of the baffles 38 and thus is directed into the frusto-conical back section 35 of the body, and at the same time water is scooped into this section over the rear parts of the baffles. Apart from a restricted escape of the water through the relief ports 39, water under pressure in the back section 35 leaves the interior of the body forwardly and outwardly over the rear ends of the baffles, so that a good deal of turbulence results with consequent drag.

Figure 10:
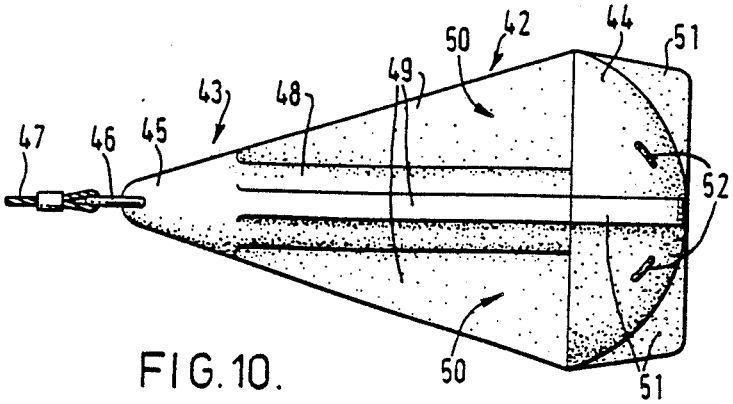
FIG. 10 is a side elevational view of a further embodiment of the invention.

The embodiment of the invention shown in FIG. 10 is substantially similar to that shown in FIGS. 6 to 9 and above described, except that the baffles 38 are omitted. The body 42 has a forwardly tapered front section 43 and a back section 44 which is of hollow spherical segmental or hemi-spherical shape rather than frusto-conical. As before described, the body 42 includes a nose 45 with a ring 46 for attachment of a hawser 47, the nose being formed integrally with an axial core 48 and four equidistantly spaced vanes 49 which define four longitudinal channels 50 in the body. The core 48 is joined axially to the back section 44, which is formed with stabilizer fins 51 and small relief ports 52.

When the device is drawn through water, the vanes 49 and fins 51 impart stability to the device, and the back section 44, and water driven into it through the longitudinal channels 50 and expelled from its periphery, apply considerable drag to the hawser 47.

Sea anchors, drag anchors or drogues according to the invention will be found to be very effective in achieving the objects for which they have been devised. It will, of course, be understood that the particular embodiments of the invention herein described and illustrated may be subject to many modifications of constructional detail and design, which will be readily apparent to persons skilled in the art, without departing from the ambit of the invention.

What is claimed is:

1. A sea anchor or drogue of the type having a body comprised of a front section tapering forwardly to a nose having means for attaching the drogue or anchor to a towing hawser, and a hollow rearwardly tapering back section, comprising:

(a) longitudinal open channels formed in the front section and leading into the hollow back section;

(b) an inwardly deflected baffle fixed in each channel to increase the depth of the associated channel from front to back, said baffle having a front which is spaced behind the front of the channel to form an opening leading into the body;

(c) a core coaxial with said body, and (d) a plurality of longtudinally extending and arcuately spaced vanes radiating from said core, said vanes defining side regions of said channels.

2. The sea anchor of claim 1, wherein relief ports are formed in, and stabilize fins are provided behind, said hollow back section of said body.

3. The sea anchor of claim 1, wherein each of said open channels increases in width from said front section to said back section.

4. A sea anchor or drogue of the type having a body comprised of a front section tapering forwardly to a nose having means for attaching the drogue or anchor to a towing hawser, and a hollow rearwardly tapering back section, comprising:

(a) longitudinal open channels formed in the front section and leading into the hollow back section;

(b) an inwardly deflected baffle fixed in each channel to increase the depth of the associated channel from front to back;

(c) a core coaxial with said body, and (d) a plurality of longitudinally extending and arcuately spaced flow-through tubes radiating from said core, said tubes defining side regions of said channels, each of said tubes having an inlet in the front section of the body and a restricted outlet in said back section.

5. The sea anchor of claim 4, wherein relief ports are formed in, and stabilizer fins are provided behind, said hollow back section of said body.

6. The sea anchor of claim 4, wherein each of the open channels increases in width from said front section to said back section.

7. A sea anchor or drogue having a body comprising a front section tapering forwardly to a nose and a hollow, rearwardly tapering back section, said nose including means for attachment to a towing hawser, wherein said front section includes a generally frusto-conical surface terminating adjacent to the back section and having a plurality of longitudinally extending and arcuately spaced vanes projecting therefrom to thereby define between adjacent vanes recessed portions which extend from the back section towards the nose, said recessed portions forming open channels for directing fluid flow, in use, from the front section into the back section, the periphery of the back section being larger than that of the front section adjacent thereto, so that the directed fluid flow, upon impinging on the back section, is directed forwardly and around the exterior of the front section.

8. The sea anchor of claim 7, wherein said channels increase in width from said front section to said back section.

9. A sea anchor or drogue having a body comprising a front section tapering forwardly to a nose and a hollow, rearwardly tapering back section, said nose including means for attachment to a towing hawser, said front section including a generally frusto-conical surface having a plurality of longitudinally extending and arcuately spaced vanes projecting therefrom to define between said adjacent vanes recessed portions which extend from the back section toward the nose, said recessed portions forming open channels for directing fluid flow, in use, from the front section into the back section, said channels increasing in width from said front section to said back section, and a baffle mounted in each channel for increasing the depth of the associated channel from the front section toward the back section.

* * * * *